United States Patent [19]

Hededam

[11] 4,182,276

[45] Jan. 8, 1980

[54] ECONOMIZER FOR SMOKE TUBE BOILERS FOR HIGH PRESSURE STEAM AND HOT WATER

[75] Inventor: Poul L. Hededam, Hals, Denmark

[73] Assignee: Indukal ApS, Denmark

[21] Appl. No.: 888,424

[22] Filed: Mar. 20, 1978

[30] Foreign Application Priority Data

Mar. 22, 1977 [DK] Denmark ..... 1254/77

[51] Int. Cl.[2] ..... F22D 1/00; F22B 9/08

[52] U.S. Cl. ..... 122/412; 122/83

[58] Field of Search ..... 122/412, 418, 37, 83, 122/90

[56] References Cited

U.S. PATENT DOCUMENTS

| | | | |
|---|---|---|---|
| 525,553 | 9/1894 | Keasbey | 122/83 |
| 543,688 | 7/1895 | Keasbey | 122/83 |
| 799,265 | 9/1905 | Reeve | 122/412 |
| 3,793,994 | 2/1974 | Olsen | 122/90 |

*Primary Examiner*—Kenneth W. Sprague

*Attorney, Agent, or Firm*—Hill, Van Santen, Steadman, Chiara & Simpson

[57] ABSTRACT

An economizer system for preheating feed or return water in a high pressure steam or hot water smoke-tube boiler having a smoke-heated convection-effecting portion. The smoke tubes at the end of the smoke tube convection-effecting portion are surrounded by a jacket with staggered baffle plates penetrated by the smoke tubes so as to form a wavy or serpentine flow channel for the feed or return water in forced counterflow to the flue gas. The jacket may be encircled by a second jacket forming a chamber which may be filled with insulating material or form a preheater in the water supply system to the flow channel of the economizer.

5 Claims, 8 Drawing Figures

Figure 1A:
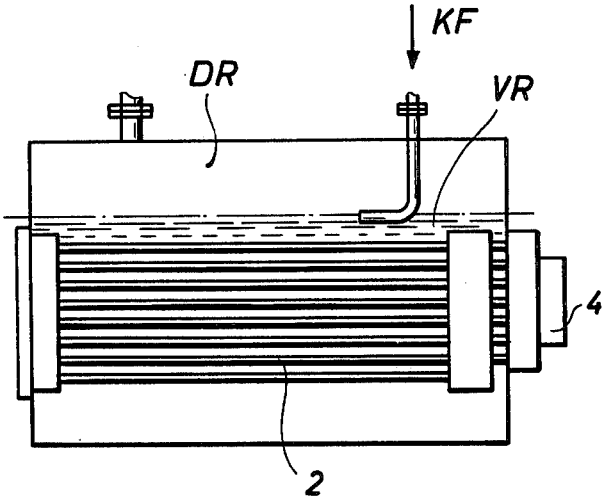
Fig. 1a (PRIOR ART)

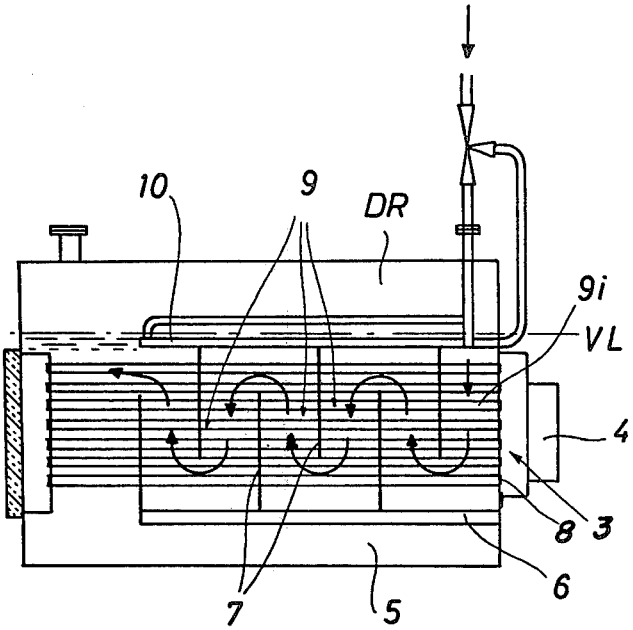
Fig.3a
Fig.3b
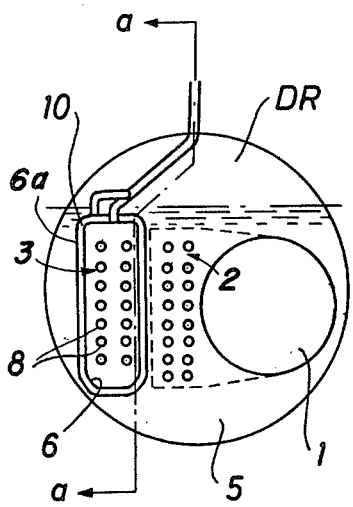
Fig.3c
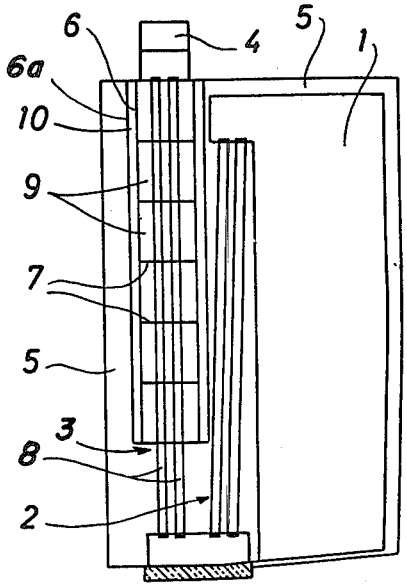

ECONOMIZER FOR SMOKE TUBE BOILERS FOR HIGH PRESSURE STEAM AND HOT WATER

BACKGROUND OF THE INVENTION a. Field of the Invention

The invention relates to an economizer for preheating feed or return water in a high pressure steam or hot water fire tube boiler having a smoke tube connection-effecting portion.

b. Prior Art

In known boilers comprising large water chambers and a smoke tube connection-effecting portion, e.g. flue/smoke tube boilers for high pressure steam and hot water, the boiler feed water and return water respectively are supplied to the water chamber of the boiler, wherein they mix with the hot boiler water, the natural or connective circulation of which within the boiler is determined by the heat transfer on the various parts of the heating surface.

Since the cooling or the smoke passing through a smoke tube, or in other words the heat transfer from the tube, is essentially determined by the temperature of the surrounding water, the outlet temperature of the smoke of such known boilers varies according to the temperature of the boiler water. The boiler is often constructed in such manner that the smoke, at maximum load, is cooled to a temperature of about 100° C. above the temperature of the boiler water, i.e. to the water temperature in the steam boilers corresponding to the saturation temperature at the boiler pressure, or to the water flow temperature in the hot water boilers. This difference of about 100° C. between the temperature of the smoke and the boiler water ensures an appropriately high specific heat transfer across the last section of the heating surface which effects natural circulation or convection of the boiler water. However, the heat content in the flue gases is normally not utilized sufficiently, i.e. the smoke heat loss (chimney loss) is too high and consequently the boiler efficiency too low.

Known boilers have to some extent solved this matter by various means.

In some of said boiler designs the smoke cooling is improved by increasing both the proportion between the length and bore of the smoke tubes, and the total heating surface of the smoke tubes. The heating surface is for instance increased by 25% so as to obtain cooling of the smoke to the temperature of the boiler water +50° C. instead of +100° C.

In other boilers, the smoke tubes are provided with turbulators of various designs. In this manner an improved cooling of the flue gas is obtained as a consequence of the higher smoke velocities etc., compared to corresponding tubes without turbulators. However, a significant smoke tube advantage is simultaneously lost, i.e. the convenience of complete inspection and cleaning of the smoke side of the boilers.

In both these known boiler types, the outlet temperature of the smoke varies with the temperature of the boiler water.

Other known boilers are provided with an economizer comprising plain or ribbed tubes so as to obtain an improved cooling of the flue gases. Such an economizer implies that the outlet temperature of the smoke varies according to the temperature of the supplied feed or return water respectively. However, several significant smoke tube advantages are simultaneously lost, i.e. the possibility of complete inspection of both the smoke and water side, and in particular the insensitivity towards moderate deposits on the water side, which is typically in smoke tube boilers.

In some known older flue/smoke tube boilers "the locomotive type boilers" the water chamber, cf. for instance Norwegian patent specification No. 90290, is provided with a screen plate, which together with the boiler shell and the rear boiler plate form a preheater space for the feed and return water respectively for steam and hot water boilers (and "water heaters").

The movement of the water in such preheater spaces of a large volume is determined by the natural circulation of "cold, downward flows" passing around the smoke tube section and "hot, upward flows" passing through said section. The average water temperature at the smoke tube heating surface is consequently relatively high, and the economizing effect of the preheater space, i.e. the cooling of the flue gas, is correspondingly low. For typically permissible feed and return water temperatures and typical steam pressure and hot water temperatures respectively, the efficiency has thus been improved by up to about 1% for steam boilers and up to about 1.5% for hot water boilers without condensing steam in the preheater space.

SUMMARY OF THE INVENTION

The object of this invention is to provide an economizer for smoke tube boilers for high pressure steam and hot water, which improves the boiler efficiency in such manner that the heat in the flue gas is better utilized as a consequence of a more effective utilization of the smoke tube heating surface and of an increase of the water circulation in the water chamber of the boiler, at the same time as the significant smoke tube boiler advantages are maintained and the outlet temperatuer of the smoke varies according to the temperature of the supplied feed and return water respectively, i.e. that the boiler efficiency can be maintained at a predetermined high value irrespective of the working pressure and the working temperature respectively.

The economizer according to the invention has smoke tubes at the end of the convection effecting portion of the boiler surrounded by a jacket, in which a number of transverse baffle plates are located, said baffle plates being penetrated by the smoke tubes and staggered so as to form a wavy or serpentine inlet channel for the feed or return water which flows in forced counterflow to the flue gas, the channel having its water inlet at the outlet end of the smoke tubes, and being open to the water chamber of the boiler at the opposite end.

This forced circulation of the feed or return water around the encircled smoke tube heating surface at the end of the convection effecting portion provides an effective utilization of said heating surface and consequently an effective cooling of the smoke under all circumstances; at the same time an increase of the water circulation in the rest of the water chamber of the boiler is achieved. This form of construction together with its operation provides an increase in the boiler efficiency and furthermore a satisfactory efficiency under varying working conditions. Since the feed or return water is forced to circulate in counterflow to the smoke movement, and since the jacket comprises transverse baffle plates spaced in such manner that the optimum water flow velocity is obtained, the predetermined cooling of the smoke is ensured. The improvement of the boiler efficiency according to the principle of the invention, increases with increasing boiler temperature and with decreasing feed water and return water temperature respectively.

In one embodiment of the economizer according to the invention, a second jacket of heat insulating or conducting material encircles said jacket and forms a chamber, which, as required, may be filled with insulating material or be connected as a preheater chamber in the water supply system to the inlet of the economizer.

Within the common limits for performance, working pressure, and working temperature for smoke tube boilers for high pressure steam and hot water, and with typical feed and return water temperatures of about 100° C. and about 140° C. respectively for the steam and hot water boilers, such economizers can provide a cooling of the smoke to a temperature of about 180° C. at maximum load with oil-firing and 14% $CO_2$ in the smoke. Such operation has a smoke heat loss of about 7%, because the optimum proportions are provided for the volume of the surrounded smoke tube heating surface, the water velocities through the economizer, and the heat exchange between the economizer water, the preheater water, and the boiler water around the jacket system.

At the same time the jacket system and the regulation of the water flows through said system can under all circumstances be constructed in such a manner that the economizers of the steam boilers are not supplied with water of such low temperatures that nonpermissibly low heating surface temperatures may occur. A corresponding security in the hot water boilers may under all circumstances be obtained by the jacket system or by an external shunt arrangement or by a combination of said preheater systems.

Smoke tube boilers comprising one or several flues may without difficulty be provided with such economizers.

The invention is described below with reference to the accompanying drawings.

Figure 1B:
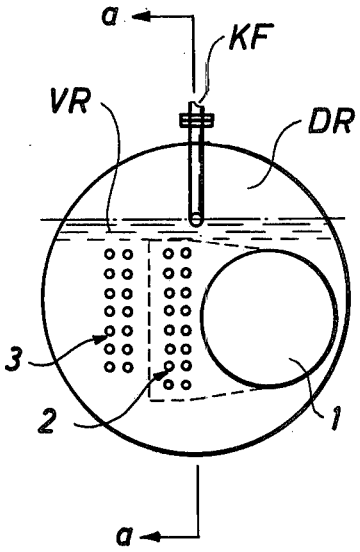
Fig. 1b (PRIOR ART)
Figure 2A:
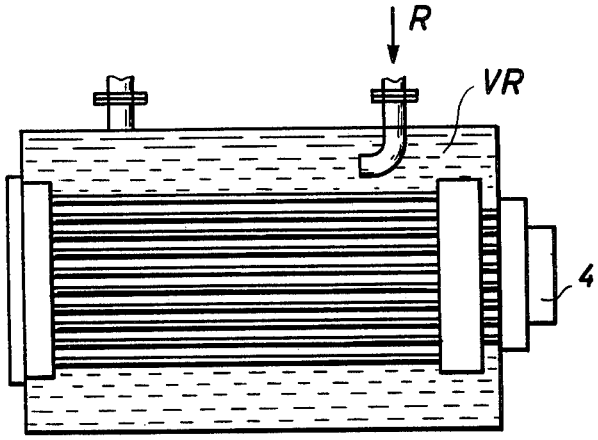
Fig. 2a (PRIOR ART)
Figure 2B:
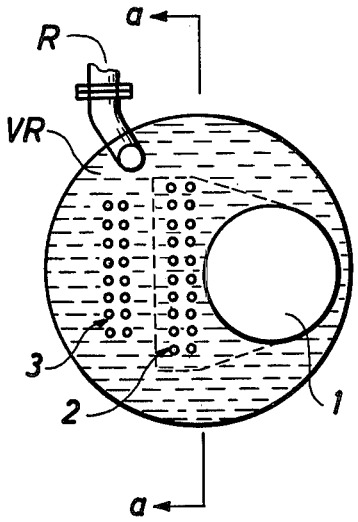
Fig. 2b (PRIOR ART)
Figure 4:
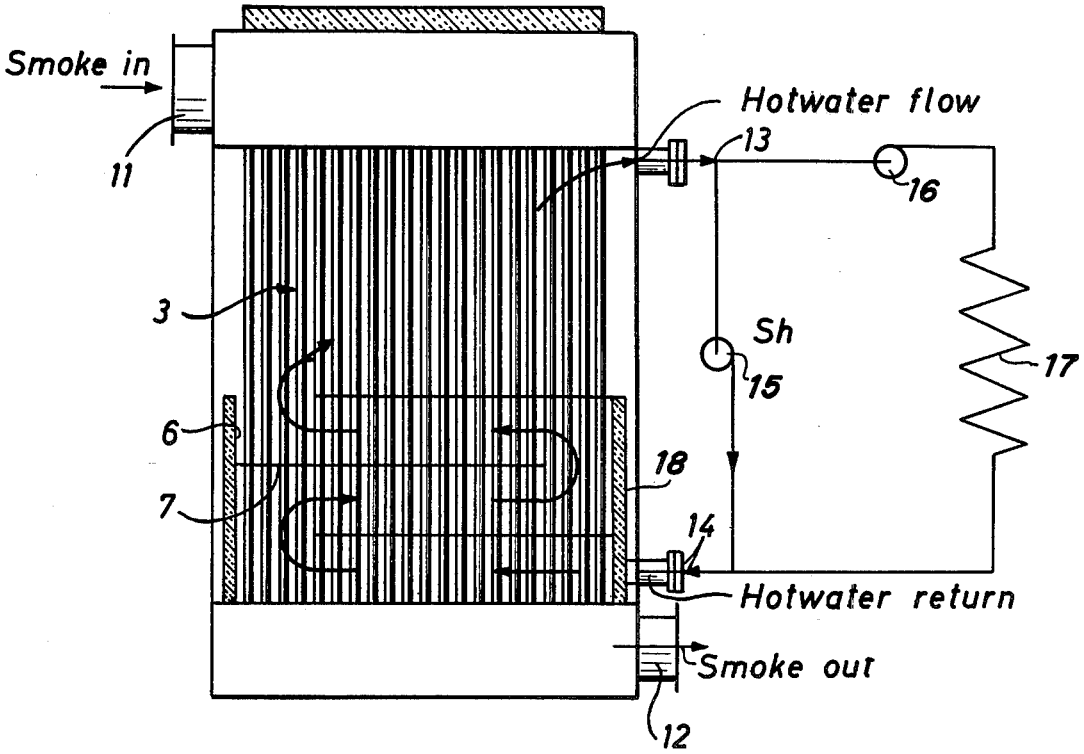

ON THE DRAWINGS:

FIGS. 1*a* and 1*b* are a longitudinal cross-section taken along the line a—a of FIG. 1*b* and a cross-sectional, diagrammatical view respectively of a known flue/smoke tube boiler for high pressure steam;

FIGS. 2*a* and 2*b* are a longitudinal cross-section taken along the line a—a of FIG. 2*b* and a cross-sectional view respectively of a known flue/smoke tube boiler for hot water;

FIGS. 3*a*, 3*b*, and 3*c* are a longitudinal cross-section taken along the line a—a of FIG. 3*b*, a cross-sectional view, and a longitudinal cross-section seen from the top respectively of a 3-pass flue/smoke tube boiler for high pressure steam incorporating an embodiment of the economizer according to the invention; and FIG. 4 is a vertical sectional view of a 1-pass, vertical exhaust-gas smoke tube boiler for hot water comprising an embodiment of the economizer according to the invention.

AS SHOWN ON THE DRAWINGS:

FIG. 1 illustrates a flue/smoke tube boiler for high pressure steam wherein the boiler feed water flows through a pipe KF into the water chamber VR of the boiler. In the water chamber, feed water mixes with the hot boiler water, the natural or convective circulation of which in the boiler is determined by the heat transfer from the various parts of the heating surface. The heating surface comprises the fire flue 1 of the boiler through which hot smoke flows in a first pass, the fire flue 1 thus absorbing heat therefrom and functioning as a radiation surface. The heating surface further comprises a convection effecting portion which is composed of a pair of smoke tube sections 2, 3, the smoke tube sections 2 and 3 being connected in series with each other and with the fire flue 1 and thus providing a second and a third pass for smoke flow leading to a smoke outlet 4. As shown in FIG. 2, in a prior art hot water boiler, return water flows through a pipe R into the water chamber VR of the hot water smoke tube boiler, and mixes with the hot boiler water. The circulation of the water in the boiler is substantially determined by the heat transfer from the various parts of the heating surface which corresponds to that of FIG. 1.

In the prior art boilers of FIGS. 1 and 2, the outlet temperature of the smoke varies as a function of the temperature of the boiler water since the heat transfer from the smoke in the smoke tubes to a high degree is dependent on the temperature of the surrounding water. Therefore, the boiler efficiency over the load range of the boilers decreases in proportion to increasing pressure within the steam boilers and in proportion to increasing water supply temperature within the hot water boilers.

The FIG. 3 views illustrate a boiler having an economizer according to the invention. This boiler is a 3-pass flue/smoke tube boiler wherein the combustion takes place in the fire flue 1 and the smoke is carried through a pair of sections of smoke tube 2 and 3 of the convection effecting portion into a smoke outlet 4 of the boiler.

An economizer is disposed in a water chamber 5 of the boiler about the rear part of the smoke tube section 3. This economizer comprises a jacket 6 and a number of baffle plates 7 penetrated by the smoke tubes 8 of the smoke tube section 3 and staggered so as to form a series of circulation chambers 9. The preheated feed or return water is forced through the circulation chambers 9 in a wavy or serpentine flow since the water at first is carried into the circulation chamber 9*i* at the smoke outlet 4, i.e. the feed or return water flows in counterflow to the direction of the smoke flow. The economizer is provided with a second jacket 6*a* encircling said jacket 6, whereby a space or chamber 10 is formed for use as a preheater, or it may be filled with insulating material (FIG. 4).

The feed water flows through the preheater chamber 10, the feed water typically having a temperature of 100° to 105° C. In the preheater 10, the water is heated to a temperature that ensures that the boiler heating surface is never cooled so much that the surface temperature on the smoke side is lower than the dew point temperature of the flue gases. With oil-firing, the feed water must usually be preheated to a temperature of 120° to 140° C. depending on the sulphur content of the oil.

Correspondingly, the return water of a hot water boiler may be preheated to corresponding temperatures. As shown in FIG. 4, the return water temperature may be increased by adding boiler water by means of a shunt pump 15. The smoke tubes 3, the jacket 6, and the baffle plates 7 correspond in structure to those elements described above. The smoke is supplied to an inlet 11 and leaves at an outlet 12 while the hot water outlet 13 and the return water inlet 14 communicate with a pump 16 and radiation means 17.

The economizer according to the invention decreases the smoke outlet temperature of the boiler considerably, cf. the following comparative example:

A conventional high pressure steam or hot water boiler is often constructed in such manner that at maximum load it cools the smoke to a temperature which is 100° C. above the boiler water temperature. Thus with at 15 ato steam boiler with feed water preheated to 130° C., or a hot water boiler in which the water temperature is 200° C. and the return water temperature is 130° C., such boilers would operate with a smoke temperature of 300° C. at maximum load.

By using the economizer of this invention in such a steam boiler with a water temperature of 200° C. and an inlet temperature of the feed water of about 100° C. to the preheater in the steam boilers, or about 130° C. to the economizer in the hot water boilers respectively, the smoke outlet temperature of the boiler is decreased from 300° C. to 180° C., which corresponds to a reduction of the smoke loss of 12%−7%=5% with oil-firing and a $CO_2$ content in the smoke of 14% and an air inlet (ambient) temperature of 20° C.

The invention provides a better utilization of the encircled smoke tube heating surface and an increase of the water circulation in the rest of the water chamber of the boiler. Furthermore, the aforesaid construction, in which the feed or return water is preheated, eliminates the risk of a sporadically nonpermissible heating surface temperature, which may be present in boilers in which unpreheated water is supplied directly to the water chamber as illustrated in FIGS. 1 and 2.

The above cooling of the smoke is ensured by adjusting the economizer heating surface area, the water velocities, and the temperatures in the economizer, the preheater, and the boiler.

The present invention may be modified in various manners. The shunt arrangement of FIG. 4 may for instance be replaced by other accessories for preheating the water before it reaches the inlet to the chamber 10 or the inlet to the chamber 9*i* of the economizer.

I claim:

1. In a boiler having smoke tubes extending through a water chamber, the smoke tubes effecting convection of water in the chamber, and an economizer for preheating water, said economizer comprising:

(a) a first jacket surrounding only a portion of the smoke tubes adjacent to their gas-discharge end;

(b) a plurality of spaced transverse baffle plates in said jacket through which said portion of said smoke tubes extends, said baffle plates defining a serpentine water channel through which all the water to be preheated can be forced in counterflow to the flue gas in said smoke tubes, said channel having a water inlet at the outlet end of said smoke tubes, and said channel discharging into said water chamber; and (c) a second jacket encircling said first jacket and defining a space therebetween, said space having a fluid connection with said water inlet and being part of the path through which the water flows en route to said channel.

2. A boiler construction comprising:

(a) a housing defining a main water heating chamber;

(b) smoke tubes secured to said housing and extending through said water heating chamber for effecting convection of water in said water chamber, at least certain of said smoke tubes being connected to a common smoke outlet;

(c) an internal jacket disposed within said water heating chamber for being submersed in and surrounded by water in said water heating chamber and surrounding only a longitudinal portion of said certain smoke tubes adjacent to the common smoke outlet; and (d) a plurality of spaced baffle plates in said internal jacket defining a zig-zag channel in said jacket through which all the inlet water to be heated can be forced through an inlet in counterflow to flue gas in said smoke tubes, said channel discharging within said water heating chamber adjacent to other longitudinal portions of said certain smoke tubes lying remotely from said internal jacket.

3. A boiler according to claim 2, including a second internal jacket encircling said first-named internal jacket and defining a space therebetween, and insulating material filling said space.

4. A boiler according to claim 2, including a shunt pump fluidly connecting an outlet of said water chamber to said inlet of said channel for mixing hot boiler water with other water entering said inlet.

5. A boiler according to claim 3, including a shunt pump fluidly connecting an outlet of said water chamber to said inlet of said channel for mixing hot boiler water with other water entering said inlet.

* * * * *